United States Patent [19]

Haide

[11] Patent Number: 4,565,489

[45] Date of Patent: Jan. 21, 1986

[54] SELF-PRIMING CENTRIFUGAL PUMP

[75] Inventor: Karl Haide, Friedrichshafen, Fed. Rep. of Germany

[73] Assignee: Motoren- und Turbinen-Union Friedrichshafen GmbH, Fed. Rep. of Germany

[21] Appl. No.: 398,908

[22] Filed: Jul. 16, 1982

[30] Foreign Application Priority Data

Oct. 16, 1981 [DE] Fed. Rep. of Germany ..... 3141080

[51] Int. Cl.[4] ..... F04D 9/02

[52] U.S. Cl. ..... 415/53 R

[58] Field of Search ..... 415/53 R, 52, 213 C, 415/11

[56] References Cited

U.S. PATENT DOCUMENTS

| | | | |
|---|---|---|---|
| 2,428,487 | 10/1947 | Fernstrum | 415/53 R |
| 2,755,743 | 7/1956 | Rupp | 415/53 R |
| 3,322,071 | 5/1967 | Teter | 415/53 R UX |
| 4,355,950 | 10/1982 | Pollak | 415/53 R |

FOREIGN PATENT DOCUMENTS

| | | | |
|---|---|---|---|
| 214282 | 3/1961 | Austria | 415/53 R |
| 460699 | 11/1949 | Canada | 415/53 R |
| 808081 | 1/1959 | United Kingdom | 415/53 R |

*Primary Examiner*—Robert E. Garrett
*Assistant Examiner*—Joseph M. Pitko
*Attorney, Agent, or Firm*—Craig & Burns

[57] ABSTRACT

A self-priming centrifugal pump wherein an external formation of a mixture formed of a storage liquid and drawn-in air from a suction line begins during a priming operation. The mixture is conveyed into a venting chamber arranged above a pump impeller wherein the air is at least partially separated and the liquid is recycled into two partial quantities to a pump volute to repeat the mixture formation. The first partial quantity is conducted to the pump volute by way of a backflow duct and a nozzle. The second partial quantity passes through a stilling chamber and surrenders or releases any residual amount of air contained in the second partial quantity. A connection between the stilling chamber and pump volute terminates into the pump volute downstream of the nozzle and is exposed by the nozzle jet in an ejector-type manner thereby enabling the accomplishment of a rapid venting of the suction line during the priming operation as well as an achievement of a high degree of efficiency and delivery during a liquid conveying process by the pump.

9 Claims, 2 Drawing Figures

SELF-PRIMING CENTRIFUGAL PUMP

BACKGROUND OF THE INVENTION

The present invention relates to a pump arrangement and, more particularly, to a self-priming centrifugal pump with an external arrangement for controlling mixture formation effective during a priming step. The pump includes a pump volute commencing at a position above a pump impeller and surrounding the pump impeller, which volute is adapted to conduct a conveyed liquid into a venting chamber arranged above the pump impeller. An air-liquid mixture, conveyed during a priming step, is unmixed by the utilization of a return-flow duct connecting the venting chamber with the pump volute, which return-flow duct terminates into the pump volute at a position below the pump impeller.

Centrifugal pumps of the aforementioned type have been purposed which are capable, with the aid of a stored liquid remaining in the pump after a shutdown, of venting an empty suction or intake line within a certain time period during a restarting process of the pump.

A disadvantage of known pumps of the aforementioned type, utilized for cooling purposes, resides in the fact that the procedure necessary for venting an emptied suction line takes too long and a suction head attainable in dependence upon the number of revolutions of the pump lies far below a possible maximum theoretical value. This is due to an inadequate venting of the air-liquid mixture in the venting chamber, the ventingbeing impeded by a constant feeding of a new mixture from the volute into the venting chamber. Consequently, during start up liquid still greatly enriched with air passes through the return-flow duct into the pump volute, and thus the pump volute can accept, at that point, only small amounts of air from the suction or intake line.

A further disadvantage of the known centrifugal pump construction resides in the fact that, due to the high proportion of air, return-flow ducts having large cross sections are required to enable a transporting of sufficient liquid into the pump volute. The result being that, during operation of the pump, a large internal liquid circulation occurs within the pump with a corresponding reduction in a delivery output and degree of efficiency of the pump.

SUMMARY AND OBJECTS OF THE INVENTION

The aim underlying the present invention essentially resides in providing a self-priming centrifugal pump which minimizes a time period between an activation of the pump and a commencing of a purely liquid transport while also coming as near as possible to a maximum possible theoretical suction head during this process and, at the same time, dimensioning to a maximally small extent, a degree of efficiency and delivery in conveying the liquid in comparison to pumps of the same construction without self-priming capabilities.

In accordance with advantageous features of the present invention, a nozzle means forms a termination of the return-flow duct into the pump volute, with a quieting chamber being arranged beside the pump impeller, the pump volute, and the return-flow duct. The quieting chamber is supplied with liquid directly from the venting chamber or from the return-flow duct and a connection is provided between the quieting chamber and the pump volute, with an opening of the connection on a side of the pump volute being arranged downstream of the nozzle means of the return-flow duct, wherein exposure to the duct flow from the nozzle means causes liquid to be drawn from the quieting chamber in the manner of an ejector.

By virtue of the above-noted features of the present invention, an amount of liquid fed to the pump volute is subdivided during a priming step into partial quantities. A first partial quantity of the liquid, conducted through the return-flow duct, being restricted by fashioning the termination of the return-flow duct into the pump volute as a nozzle means having a correspondingly small cross section, and a second partial quantity of the liquid, conducted through the quieting chamber, being capable of most extensively surrendering or releasing the air contained therein, due to the large volume and relatively large height of the quieting chamber, so thereby only pure liquid is fed to the pump volute.

According to the present invention, the ejector effect of the nozzle means when the first partial quantity passes therethrough causes a substantially throughput or through flow through the quieting chamber, and an intensive intermixing of both liquid quantities with the air from the suction line is effected in the pump volute. Consequently, the intake time is substantially reduced, and the suction head is increased. Once the priming process is concluded by the onset of liquid conveyance, the nozzle effect is overcome by filling up of the pump volute with liquid and a buildup of the volute pressure, so that the internal liquid circulation and, consequently, the drop in delivery and efficiency is lessened as compared with a pump without the self-priming capabilities, and occurs merely to a negligible extent.

Advantageously, in accordance with further features of the present invention, the nozzle means terminating into the pump volute has a rectangular cross section at its outlet, with a width of the rectangular cross section corresponding approximately to a width of the pump volute, and a height of the cross section being 3–4 percent of a diameter of an impeller suction or intake orifice.

In accordance with still further features of the present invention, a connection arranged between the quieting chamber and pump volute is formed as a bore having a center which is spaced from the nozzle means by 12–16 percent of a diameter of the suction or intake orifice and a cross section of which is 1–2 percent of a cross section of the suction or intake orifice.

The inlet to the quieting chamber may, in accordance with the present invention, include several bores which together exhibit a cross section having a maximum of 6 percent of a cross section of the impeller suction or intake orifice.

Advantageously, a further connection may be disposed between the quieting chamber and the return-flow duct, with the further connection being disposed a short distance upstream of the nozzle means. The cross section of the further connection may amount to about 3–4 percent of a diameter of the suction or inlet orifice of the impeller.

Accordingly, it is an object of the present invention to provide a self-priming centrifugal pump which avoids, by simple means, shortcomings and disadvantages encountered in the prior art.

Another object of the present invention resides in providing a self-priming centrifugal pump which minimizes the time necessary between an activation of the pump and a commencing of a pure transport of liquid by the pump.

Yet another object of the present invention resides in providing a self-priming centrifugal pump which maximizes the suction head during a starting process of the pump.

A further object of the present invention resides in providing a centrifugal pump which functions reliably under all operating conditions.

A still further object of the present invention resides in providing a self-priming centrifugal pump which is simple in construction and therefore relatively inexpensive to manufacture.

These and other objects, features and advantages of the present invention will become more apparent from the following description when taken in connection with the accompanying drawing which shows, for the purposes of illustration only, one embodiment in accordance with the present invention, and wherein:

DESCRIPTION OF THE PREFERRED EMBODIMENT

Figure 1:
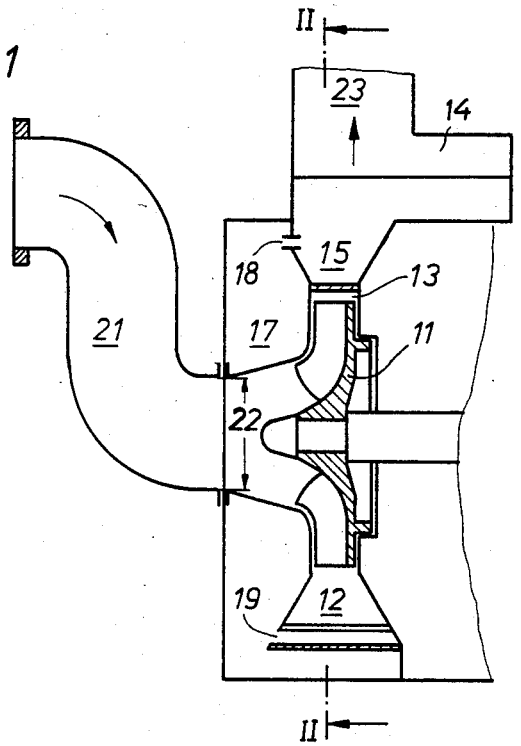
FIG. 1 is a longitudinal cross sectional schematic view of a self-priming centrifugal pump constructed in accordance with the present invention taken along line I—I of FIG. 2.

Referring now to the drawing wherein like reference numerals are used in both views to designate like parts and, more particularly, to FIG. 1, according to this figure, a pump impeller 11 of a centrifugal pump is surrounded by a pump volute or spiral case 12 beginning at a position 13 above the pump impeller 11, with the pump volute 12 being adapted to convey a liquid transported by the pump impeller 11 into a venting chamber 14 arranged above the pump impeller 11. A return-flow duct 15 connects the venting chamber 14 with the pump volute 12, with the return-flow duct 15 terminating in the pump volute 12. The termination point of the return-flow duct 15 into the channel 12 is constructed as a nozzle 16.

Figure 2:
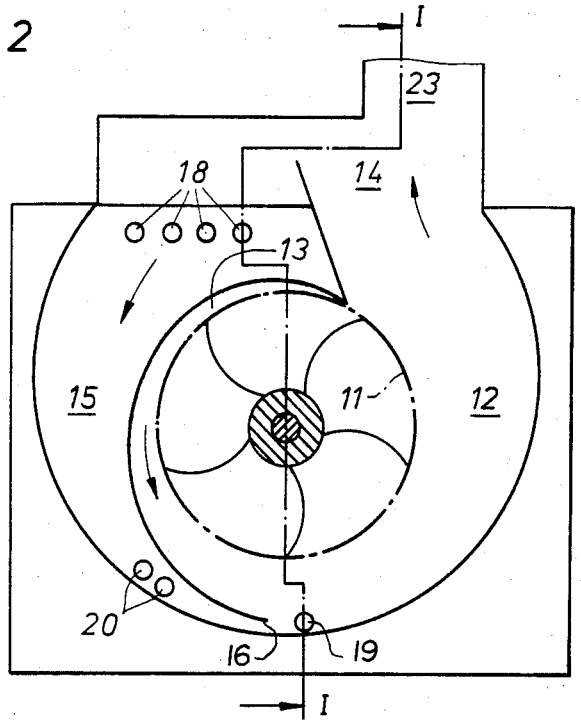
FIG. 2 is a cross sectional view taken along line II—II of the self-priming centrifugal pump of FIG. 1.

A quieting chamber 17 is located beside the pump impeller 11, the pump volute 12, and the return-flow duct 15, with the quieting chamber 17 being supplied with liquid by the return-flow duct 15 through communicating bores 18. A further communicating bore 19 is arranged between the quieting chamber 17 and pump volute 12, with an opening of the communicating bore 19 on a side of the pump volute 12 being arranged downstream of the nozzle 16 of the return-flow duct 15. The bore 19 is exposed, in the manner of an ejector, to a jet of liquid from the return-flow duct 15, caused by the nozzle 16. As shown most clearly in FIG. 2, additional communicating bores 20 are disposed between the quieting chamber 17 and return-flow duct 15 at a position located a short distance upstream of the nozzle 16.

A suction or intake line 21 is arranged in front of the centrifugal pump, as viewed in a normal flow direction, with the suction line 21 being in communication with the pump impeller 11 through a suction orifice or opening 22. A pressure or discharge line 23 is located downstream of the pump.

The intake line 21 is conventionally constructed so that a certain amount of liquid remains therein after a shutdown of the pump and, prior to an initial startup, the pump must be filled up with this amount of liquid.

With each activation of the pump, the amount of remaining liquid is conveyed by vanes of the impeller 11 into the pump volute 12, mixed at the startup stage with air from the suction or intake line 21, with the mixture of air and liquid being conveyed into the venting chamber 14. In the venting chamber 14, at least a substantial portion of the air is separated from the liquid and flows into the pressure line 23, with the liquid, more or less freed of the air, passing into the return-flow duct 15 and from there, in part, through the nozzle 16 back into the pump volute 12. Another part of the liquid passes through the bores 18 into the quieting chamber 17 and is separated therein from the air contained in this part of liquid being transported. By the action of the nozzle 16, liquid from the quieting chamber 17 is taken in in an ejector-like manner by the bore 19, mixed with the air from the suction line 21, and returned into the venting chamber 14 by way of the pump volute 12.

The above-noted process is continuously repeated until the air has been pumped out of the suction or intake line 21 and the conveyance of only liquid begins.

Experimentation has established that the above-noted procedure of self-priming may be even further enhanced by the provision of additional communicating bores 20 between the quieting chamber 17 and the return-flow duct 15.

Advantageously, the nozzle 16 terminating into the pump volute 12 has a rectangular cross section at the outlet with a height thereof being 3–4% of the diameter or cross section of an impeller suction orifice 22. Ideally, the communicating bore 19 is spaced from the nozzle 16 by 12–16% of a diameter or cross section of the impeller suction orifice 22 and has a cross section which is 1–2% of the cross section of the impeller suction orifice 22. The total cross section of the bores 18 leading into the quieting chamber is a maximum of 6% of the cross section of the impeller suction orifice 22, with a cross section of the additional communicating bores 20 amounting to 3–4% of the diameter of the impeller suction orifice 22.

While I have shown and described only one embodiment in accordance with the present invention, it is understood that the same is not limited thereto but also contemplates numerous changes and modifications as would be known to those skilled in the art, and I therefore do not wish to be limited to the details shown and described herein but intend to cover all such changes and modifications as are encompassed by the scope of the appended claims.

I claim:

1. A self-priming centrifugal pump with an arrangement for controlling mixture formation effective during a priming operation, the pump comprising pump impeller means, pump volute means beginning above and surrounding the pump impeller means for conducting liquid, venting chamber means arranged above the impeller means for receiving an air-liquid mixture from the pump volute means during the priming operation, and return-flow duct means terminating in the pump volute means at a position below the pump impeller means for connecting the venting chamber means with the pump volute means, said return-flow duct means terminating in a nozzle means, quieting chamber means operatively arranged beside the pump impeller means, pump volute means and return-flow duct means for receiving liquid directly from at least one of the venting chamber means and return-flow duct means, means for communicating the quieting chamber means with the pump volute means, said means for communicating terminating on a side of the pump volute means at a position arranged downstream of the nozzle means and being exposed to a jet from the nozzle means in the manner of an ejector, and means for communicating the quieting chamber means with the return-flow duct means, said lastmentioned means for communicating being disposed at a position a short distance upstream of the nozzle means and having a cross-section amounting to about 3–4 percent of the cross section of a suction orifice of the pump impeller means.

2. A self-priming centrifugal pump according to claim 1, wherein a plurality of bore means are provided for forming an inlet for the quieting chamber means, a total cross-section of the plurality of bore means is a maximum of about 6 percent of a cross-section of a suction orifice of the pump impeller means.

3. A self-priming centrifugal pump with an arrangement for controlling mixture formation effective during a priming operation, the pump comprising pump impeller means, pump volute means beginning above and surrounding the pump impeller means for conducting liquid, venting chamber means arranged above the impeller means for receiving an air-liquid mixture from the pump volute means during the priming operation, and return-flow duct means terminating in the pump volute means at a position below the pump impeller means for connecting the venting chamber means with the pump volute means, said return-flow duct means terminating in a nozzle means, quieting chamber means operatively arranged beside the pump impeller means, pump volute means and return-flow duct means for receiving liquid directly from at least one of the venting chamber means and return-flow duct means, means for communicating the quieting chamber means with the pump volute means, said means for communicating terminating on a side of the pump volute means at a position arranged downstream of the nozzle means and being exposed to a jet from the nozzle means in the manner of an ejector, and means for communicating the quieting chamber means with the return-flow means.

4. A self-priming centrifugal pump according to claim 3, wherein the nozzle means has an outlet having a rectangular cross-section, a width of the rectangular cross-section corresponds approximately to a width of the pump volute means, and the height of the rectangular cross-section is between about 3–4 percent of the diameter of a suction orifice of the pump impeller means.

5. A self-priming centrifugal pump according to claim 4, wherein the means for communicating includes a bore arranged between the quieting chamber means and pump volute means, the bore includes a center axis spaced from the nozzle means by a distance of about 12–16% of the diameter of the suction orifice and the bore has a cross section of 1–2% of the cross section of the suction orifice.

6. A self-priming centrifugal pump according to one of claims 3, 4 or 5, wherein the means for communicating the quieting chamber means and the return-flow means includes a plurality of bore means for forming an inlet for the quieting chamber means, and the total cross section of the plurality of bore means is a maximum of about 6% of a cross section of a suction orifice of the pump impeller means.

7. A self-priming centrifugal pump according to claim 6, wherein additional means are provided for communicating the quieting chamber means with the return-flow duct means, said additional means for communicating being disposed at a position a short distance upstream of the nozzle means and having a cross section amounting to about 3–4% of the cross section of a suction orifice of the pump impeller means.

8. A self-priming centrifugal pump according to claim 3, wherein the means for communicating the quieting chamber means with the pump volute means includes a bore arranged between the quieting chamber means and the pump volute means, the bore includes a center axis spaced from the nozzle means by a distance of about 12–16% of a diameter of a suction orifice of the pump impeller means and the bore has a cross section of 1–2% of the cross section of the suction orifice.

9. A self-priming centrifugal pump according to one of claims 4 or 8, wherein additional means are provided for communicating the quieting chamber means with the return-flow duct means, said additional means for communicating being disposed at a position a short distance upstream of the nozzle means and having a cross-section amounting to about 3–4 percent of the cross section of a suction orifice of the pump impeller means.

* * * * *